US009775434B2

(12) United States Patent
Flogaus

(10) Patent No.: US 9,775,434 B2
(45) Date of Patent: Oct. 3, 2017

(54) DRIVE DEVICE FOR MOVEABLE FURNITURE COMPONENT

(71) Applicant: Julius Blum GmbH, Hoechst (AT)

(72) Inventor: Alexander Simon Flogaus, Hoechst (DE)

(73) Assignee: JULIUS BLUM GMBH, Hochst (AT)

( * ) Notice: Subject to any disclaimer, the term of this patent is extended or adjusted under 35 U.S.C. 154(b) by 322 days.

(21) Appl. No.: 14/308,799

(22) Filed: Jun. 19, 2014

(65) Prior Publication Data

US 2014/0300262 A1 Oct. 9, 2014

Related U.S. Application Data

(63) Continuation of application No. PCT/AT2012/000268, filed on Oct. 29, 2012.

(30) Foreign Application Priority Data

Dec. 27, 2011 (AT) ..... 1890/2011

(51) Int. Cl.

| | |
|---|---|
| ***A47B 88/04*** | (2006.01) |
| ***A47B 88/47*** | (2017.01) |
| ***E05F 1/16*** | (2006.01) |

(52) U.S. Cl.

CPC ..... *A47B 88/0481* (2013.01); *A47B 88/47* (2017.01); *E05F 1/16* (2013.01); *A47B 2210/0078* (2013.01); *E05Y 2201/62* (2013.01)

(58) Field of Classification Search

CPC ..... A47B 88/0481; A47B 2210/0078

See application file for complete search history.

(56) References Cited

U.S. PATENT DOCUMENTS

| | | | |
|---|---|---|---|
| 7,431,410 | B2 | 10/2008 | Sato et al. |
| 7,748,799 | B2 | 7/2010 | Kleinsasser |
| 2007/0101539 | A1 | 5/2007 | Sutterlutti et al. |
| 2011/0012488 | A1 | 1/2011 | Liang et al. |
| 2011/0115353 | A1 | 5/2011 | Domenig et al. |
| 2012/0038255 | A1 | 2/2012 | Netzer et al. |
| 2013/0334946 | A1 | 12/2013 | Netzer et al. |

FOREIGN PATENT DOCUMENTS

| | | |
|---|---|---|
| CN | 1736290 | 2/2006 |
| CN | 1988827 | 6/2007 |
| CN | 101068487 | 11/2007 |
| DE | 198 23 305 | 12/1999 |

(Continued)

OTHER PUBLICATIONS

International Search Report issued Feb. 12, 2013 in International (PCT) Application No. PCT/AT2012/000268.

(Continued)

*Primary Examiner* — Matthew Ing

(74) *Attorney, Agent, or Firm* — Wenderoth, Lind & Ponack, L.L.P.

(57) ABSTRACT

A drive device for a movable furniture component, particularly for a drawer, includes an ejection device having an ejection force accumulator for ejecting the movable furniture component into an open position, and a retraction device having a retraction force accumulator for retracting the movable furniture component from an open position into a closed position. The ejection force accumulator can be charged by the retraction force accumulator during retraction of the movable furniture component.

17 Claims, 9 Drawing Sheets

(56) References Cited

FOREIGN PATENT DOCUMENTS

| | | |
|---|---|---|
| DE | 20 2009 009 566 | 12/2009 |
| DE | 20 2009 005 009 | 4/2010 |
| DE | 10 2010 036 741 | 2/2011 |
| DE | 20 2009 005 119 | 2/2011 |
| EP | 2 174 572 | 4/2010 |
| EP | 2 279 680 | 2/2011 |
| EP | 2 364 614 | 9/2011 |
| JP | 3154197 | 9/2009 |
| WO | 2010/009780 | 1/2010 |
| WO | 2010/112522 | 10/2010 |
| WO | 2010/129971 | 11/2010 |
| WO | 2011/143682 | 11/2011 |

OTHER PUBLICATIONS

Austrian Patent Office Search Report (ASR) Sep. 4, 2012 in Austrian Patent Application No. A 1890/2011.

European Search Report issued Feb. 3, 2016 in corresponding European Application No. 15003134 (with English translation).

DRIVE DEVICE FOR MOVEABLE FURNITURE COMPONENT

BACKGROUND OF THE INVENTION

The invention concerns a drive device for a moveable furniture part, in particular for a drawer, comprising an ejection device having an ejection force storage member for ejecting the moveable furniture part into an open position, and a retraction device having a retraction force storage member for retracting the moveable furniture part from an open position into a closed position. In addition, the invention concerns an article of furniture comprising a furniture carcass and a moveable furniture part, wherein the moveable furniture part is moveable by such a drive device.

In furniture design and construction, in particular in fitment design and construction, a wide range of different aids and methods have already been known for many years, to make opening and closing of the moveable furniture parts easier for a user of articles of furniture. Thus, opening devices (so-called ejection devices or touch-latch mechanisms) have already been known for many decades, in which the moveable furniture part is ejected and thus opened by pressing on the moveable furniture part.

In order not just to facilitate the opening movement for a user, retraction devices have already been known for many years, which pull the drawer closed of its own accord, in particular in the last part of the closing travel. That guarantees that the moveable furniture part is reliably closed. In addition, damping devices are also used to prevent an excessively heavy impact and thus prevent damage if a drawer is pushed violently closed.

A fundamental problem with drive devices or articles of furniture having an ejection device and a retraction device is that the forces of the respective force storage member for ejection and for retraction respectively act in opposition to each other. In other words, it is necessary to ensure with suitable mechanical means that on the one hand a reliable locking action is afforded, while on the other hand the respectively correct force storage member acts at the correct moment in time and in the correct portion. An important aspect in this technical field is also where and by whom or what the respective force storage member (spring) is stressed or loaded. In many cases, the ejection force storage member is loaded by the operator for example when opening or closing the drawer. For loading the retraction force storage member, it is also possible for the user to apply the necessary stressing force by way of the drawer itself, or the retraction force storage member is stressed by the ejection force storage member itself as the ejection force storage member has a greater amount of energy (spring force) than the retraction force storage member.

An example of a retraction spring which is stressed upon opening by the ejection spring is disclosed in DE 198 23 305 A1. Stressing of the retraction spring by hand is described for example in DE 20 2009 009 566 U1. In both those devices the ejection spring is respectively stressed by hand in the closing movement.

A variant in which only one spring functions both as the ejection spring and also as the retraction spring is disclosed in WO 2011/143682.

SUMMARY OF THE INVENTION

The object of the present invention is to provide a drive device for a moveable furniture part, that is improved or is an alternative in relation to the state of the art. The invention also seeks to provide that the configuration and arrangement of the force storage member are as compact as possible. The invention also seeks to provide that the spring force is used as efficiently as possible.

For a drive device of the present invention, that object is achieved in that the ejection force storage member (i.e., ejection force accumulator) can be loaded by the retraction force storage member upon retraction of the moveable furniture part. This means that there does not have to be any manual loading of the ejection force storage member, but the retraction force storage member (i.e., retraction force accumulator) is so dimensioned and arranged that the ejection force storage member is stressed upon retraction of the drawer.

As, with such a design configuration, the ejection force storage member thus has a lower level of force than the retraction force storage member, it can preferably be provided that the retraction force storage member also functions with a part of its energy as an assistance force storage member (i.e., assistance force accumulator) for ejecting the moveable furniture part. Thus, the retraction force storage means serves on the one hand for retraction and on the other hand also for ejection of the moveable furniture part.

According to a first variant of the present invention, the moveable furniture part is moveable out of the closed position into an open position only by the ejection force storage member. In other words, the ejection force storage member itself moves the moveable furniture part out of its closed position. As a further consequence of the opening movement, the moveable furniture part is moveable from an open position into a further open position by the retraction force storage member functioning as an assistance force storage member.

In contrast, in a second variant of the present invention, the moveable furniture part is moveable out of the closed position into an open position only by the assistance force storage member. In other words, the ejection force storage member does not serve for direct ejection of the moveable furniture part out of the closed position. Rather, in that case, the moveable furniture part is moveable or can be ejected from an open position into a further open position by the ejection force storage member.

In general, the possibility of the individual stressing movements or stress-relief movements of the force storage member overlapping is not to be excluded. However, for a force transmission which is as good as possible, preferably upon ejection, the moveable furniture part is moveable serially in succession by the ejection force storage member and the assistance force storage member. As can be seen from the above-described variants, upon ejection the ejection force storage member can be operative firstly followed then by the assistance force storage member, or also vice-versa.

Preferably, at least one and preferably both force storage member are in the form of springs, preferably compression springs. In that respect, a spring pack can also be deemed to constitute a spring, in which case the individual springs of a spring pack have the same stressing and stress-relief travel and the same beginning and end points of the respective stressing and stress-relief travel. Preferably, the spring constant of the ejection force storage member is less than that of the retraction force storage member. In other words, in the stressed condition of both force storage member, the spring force of the retraction force storage member is higher than the spring force of the ejection force storage member. After the retraction force storage member has delivered at least a part of its energy, the ejection force storage member has the higher spring force than the remaining spring force in the retraction force storage member and can thus act on the moveable furniture part (see for example FIGS. 3P and 3Q).

In a preferred embodiment of the present invention, the drive device has a housing preferably arranged on a furniture carcass, a retraction slider which is acted upon by the retraction force storage member and which is displaceable along a sliding guide track in or on the housing and which is lockable in a locking position in, preferably a curved portion of, the sliding guide track, and an ejection slider which is acted upon by the ejection force storage member and which is displaceable along an ejection sliding guide track in or on the housing and which is lockable in a locking position in, preferably a cardioid-shaped portion of, the ejection sliding guide track. Such a housing with sliders and sliding guide tracks ensures that the drive device is of as compact a configuration as possible.

Preferably, the retraction slider and the ejection slider are moveable serially in succession along the housing. That serial relationship provides a compact, narrow drive device which can be well integrated into an extension guide arrangement. It is further preferably provided in that respect that the ejection force storage member is fixed on the one hand to the housing and on the other hand to the retraction slider. In contrast, the retraction force storage member is fixed on the one hand to the retraction slider and on the other hand to the ejection slider.

In principle, it is possible for the drive device to be arranged per se on the moveable furniture part and thus move with the moveable furniture part. In that respect, with an entrainment member arranged on the furniture carcass, the drive device can so-to-speak eject or retract itself. However, the retraction slider and the ejection slider can be coupled portion-wise to an entrainment member which is preferably arranged on the moveable furniture part. In other words the entrainment member is arranged on the moveable furniture part and is coupled portion-wise or at times to the retraction slider or ejection slider in such a way that the corresponding transmission of movement for retraction or ejection to the moveable furniture part is guaranteed.

To guarantee reliable smooth closure of the moveable furniture part at the end of the closing travel, there is preferably provided a damping device for damping the retraction movement of the moveable furniture part, that is triggered by the retraction force storage means.

An article of furniture can include a furniture carcass and a furniture part moveable by a drive device according to the invention.

BRIEF DESCRIPTION OF THE DRAWINGS

Further details and advantages of the present invention are described more fully hereinafter by means of the specific description with reference to the embodiments by way of example illustrated in the drawings, in which.

DETAILED DESCRIPTION OF THE DRAWINGS

Figure 1:
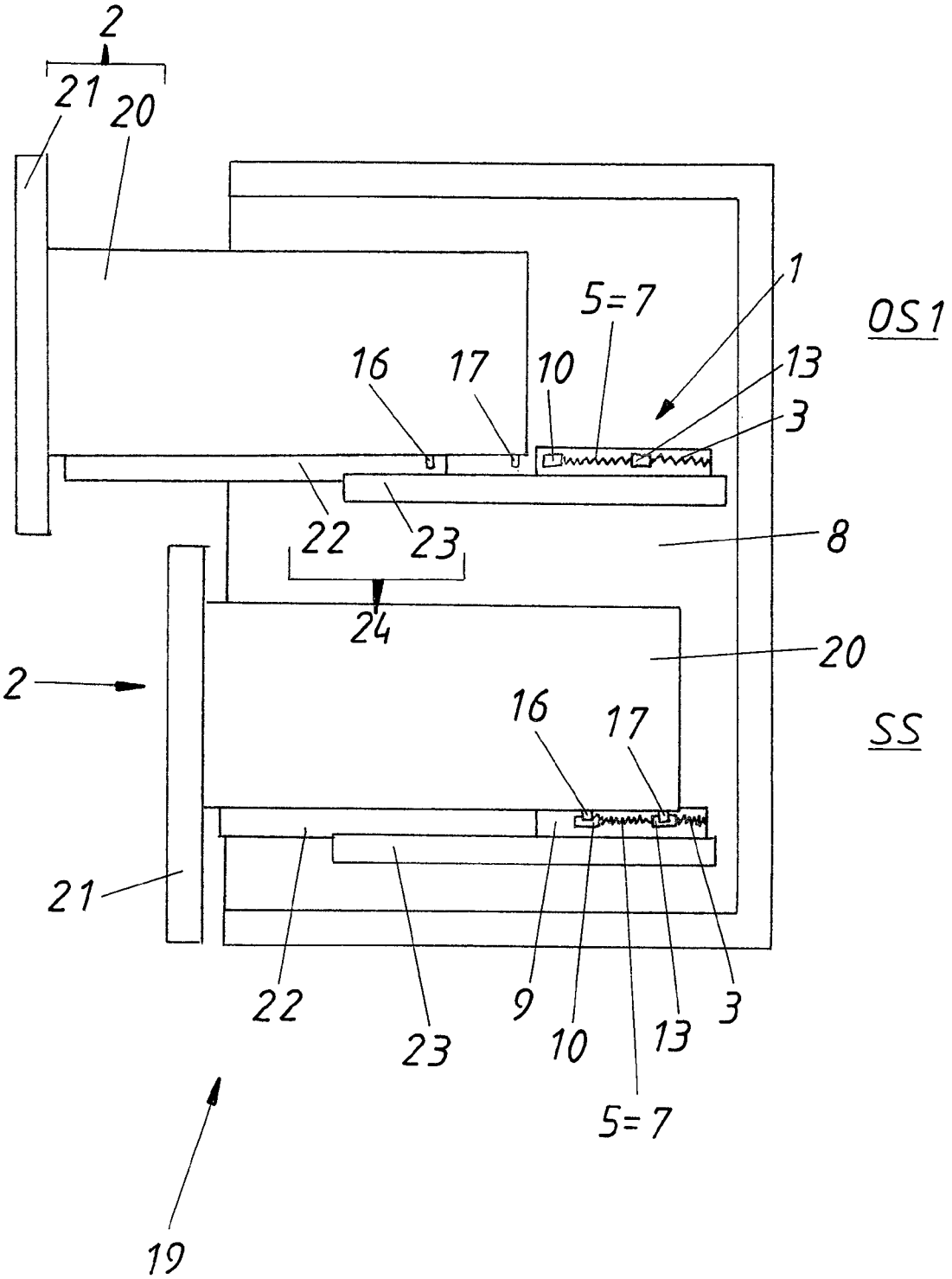
FIG. 1 diagrammatically shows an article of furniture with an open and a closed moveable furniture part, FIGS. 2A through 2R diagrammatically show a first variant of an operating procedure of a closing and opening movement, and FIGS. 3A through 3R diagrammatically show a second variant of an operating procedure of a closing and opening movement.

FIG. 1 shows an article of furniture 19 comprising a furniture carcass 8 and two moveable furniture parts 2 (drawers). Those moveable furniture parts 2 comprise a drawer box 20 and a front panel 21 and are mounted moveably by way of a drawer rail 22 on a carcass rail 23 fixed with respect to the carcass—the rails 22 and 23 together form the extension guide member 24. Arranged on the drawer box 20 (or on the drawer rail 22) are entrainment members 16 and 17 which correspond portion-wise with a drive device 1 arranged on the carcass 8 or on the carcass rail 23, respectively. The drive device 1 has a housing 9 in or on which an ejection slider 10 and a retraction slider 13 are displaceably mounted. A retraction force storage member (i.e., retraction force accumulator) 5 is arranged between the ejection slider 10 and the retraction slider 13. In comparison, the ejection force storage member (ejection force accumulator) 3 is mounted between the retraction slider 13 and the housing 9. The upper one of the illustrated drawers is disposed in a further open position OS1 while the lower one of the illustrated drawers is in the closed position SS.

Figure 2A:
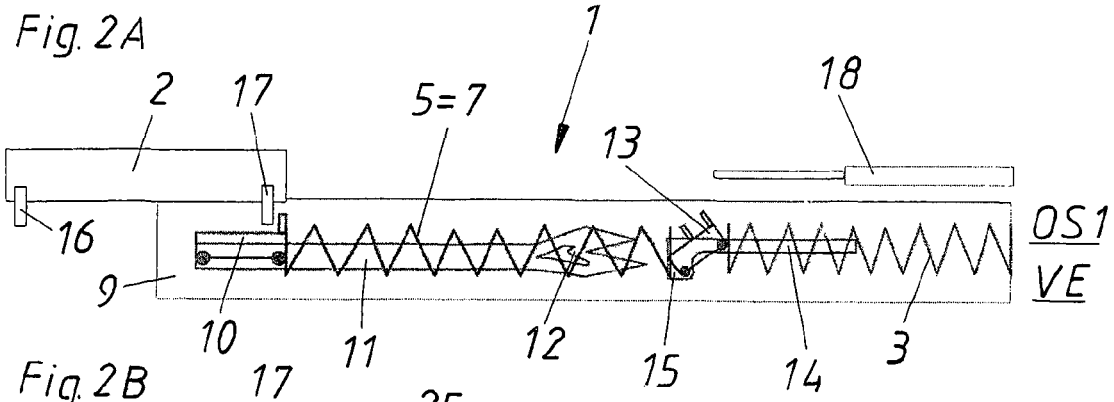

FIG. 2A shows in detail the individual components of a drive device 1. That drive device 1 includes on the one hand the entrainment members 16 and 17 arranged on the moveable furniture 2 and on the other hand the components arranged on the housing 9. Those components are on the one hand the retraction force storage member 5 (which also functions as an assistance force storage member 7) which together with the retraction slider 13 and the sliding guide track 14 together with the curved portion 15 forms the retraction device 6. On the other hand, the ejection force storage member 3 with the ejection slider 10, the assistance force storage member 7 (which also functions as the retraction force storage member 5), and the ejection sliding guide track 11 together with the cardioid-shaped portion 12 forms the ejection device 4. As shown in FIG. 2A the moveable furniture part is in a further open position OS1. The tilted retraction slider 13 is disposed in the locking position VE in the curved portion 15 of the sliding guide track 14. Both the retraction force storage means member form of a compression spring and also the ejection force storage member 3 which is also in the form of a compression spring are shown in their position of maximum stress relief (i.e., unloaded). That maximum position is established by virtue of the sliding guide tracks 14 and 11 and the respective sliders 13 and 10.

Figure 2B:
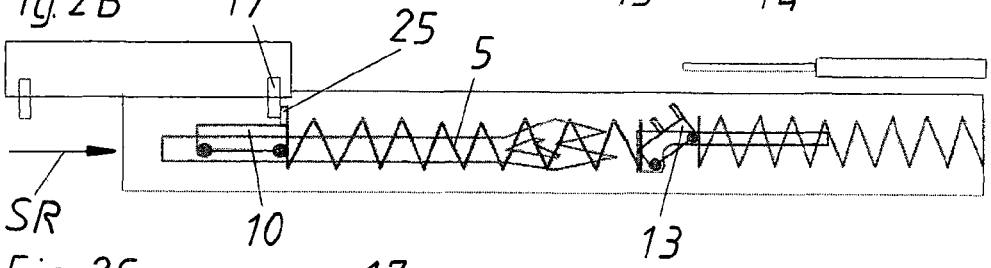
Figure 2C:
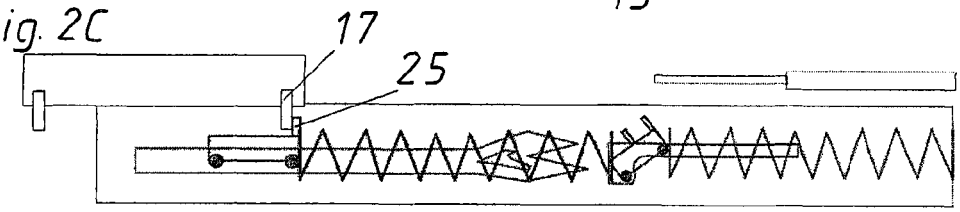
Figure 2D:
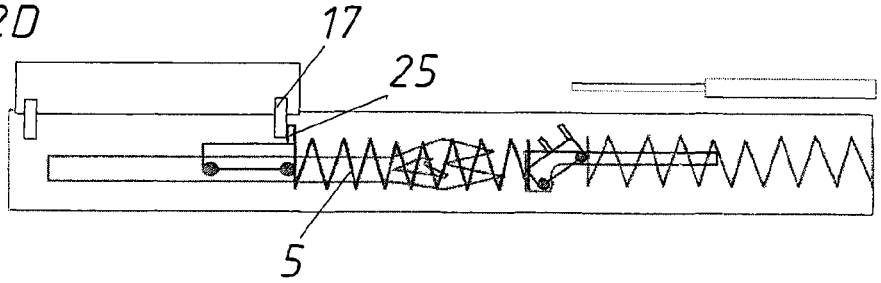
Figure 2E:
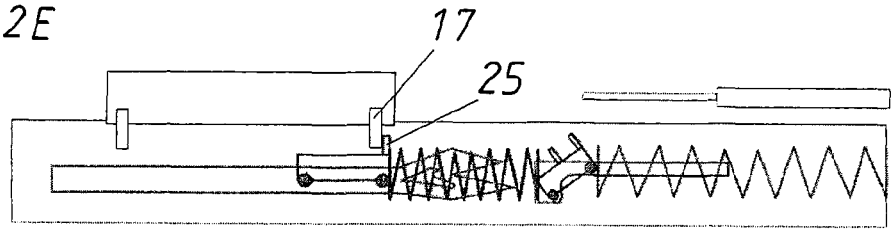

If now as shown in FIG. 2B the moveable furniture part 2 is moved by hand in the closing direction SR then firstly the first entrainment member 17 comes into contact with the actuating element 25 of the ejection slider 10. As the retraction slider 13 is held in the locking position VE that movement causes the retraction force storage member 5 to be stressed (i.e., accumulate force or become loaded; see in that respect further FIGS. 2C, 2D and 2E).

Figure 2F:
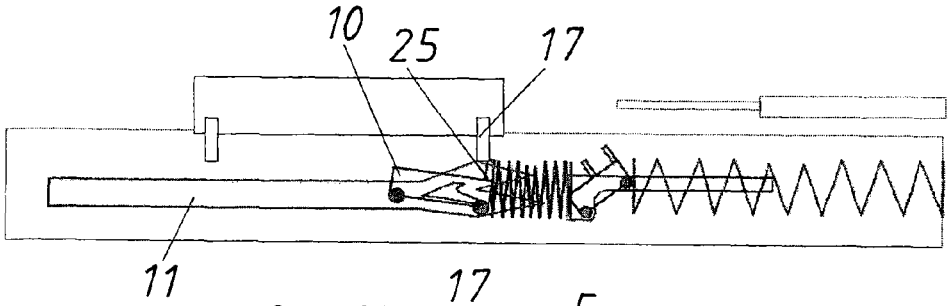

As soon as the position shown in FIG. 2F is reached, the ejection slider 10 passes into the cardioid-shaped portion 12 of the ejection sliding guide track 11 and is deflected therein so that the first entrainment member 17 comes out of engagement with the actuating element 25 of the ejection slider 10.

Figure 2G:
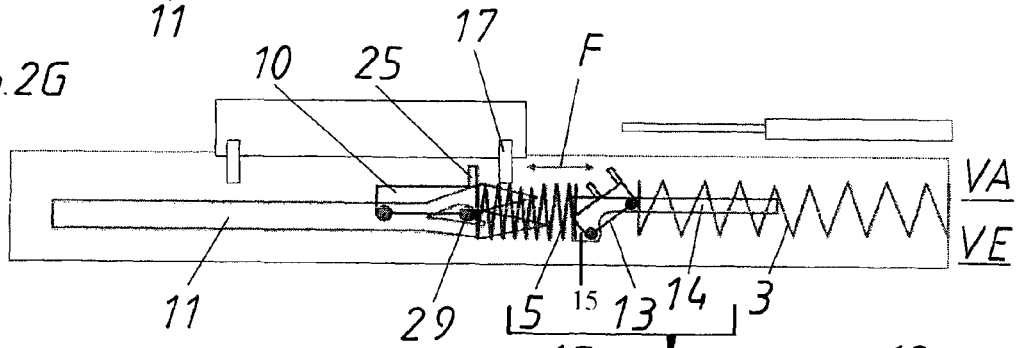

As soon as the first entrainment member 17 is no longer engaged with the actuating element 25, the retraction force storage member 5 can expand again. As, however, the ejection slider 10 is already in the cardioid-shaped portion 12 of the ejection sliding track 11, a control pin 29 of the ejection slider 10 is held in the latching recess of the cardioid-shaped portion 12 or is urged into the latching recess by the retraction force storage member 5. As a result, the ejection slider 10 passes into the locking position VA (see FIG. 2G). As the first entrainment member 17 has been released from the actuating element 25, the moveable furniture part is in the free-running situation F and can be further moved in the closing direction SR by an operator.

Figure 2H:
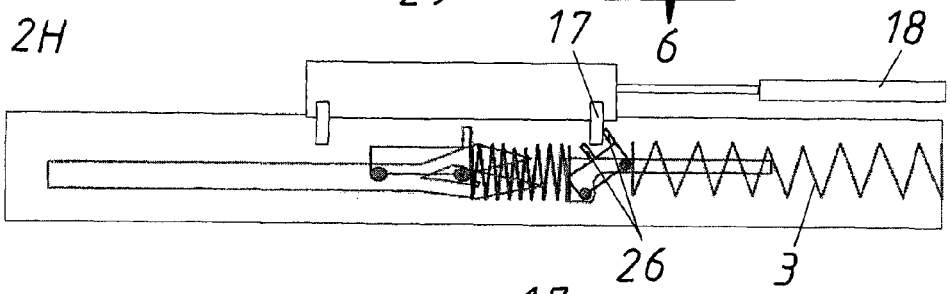

At the end of the free-running situation F, the first entrainment member 17 passes between the catch elements 26 of the retraction slider 13 (see FIG. 2H). In that position, the piston of the damper 18 also comes into abutment relationship with the moveable furniture part 2.

Figure 2I:
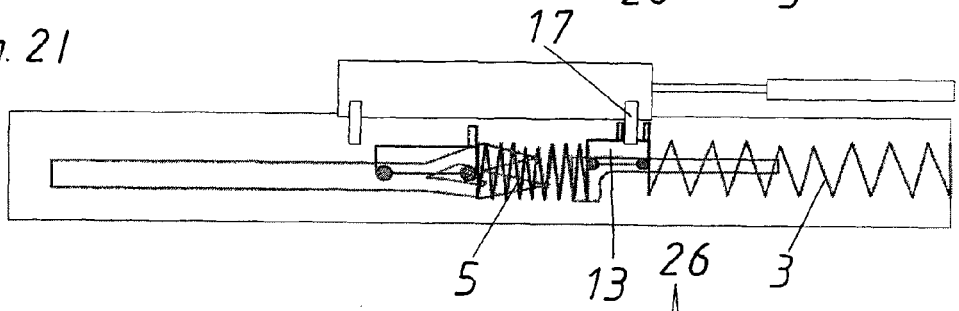

By virtue of further movement of the moveable furniture part 2 in the closing direction SR, the retraction slider 13 is moved out of its locking position VE and unlocked (see FIG. 2I).

Figure 2J:
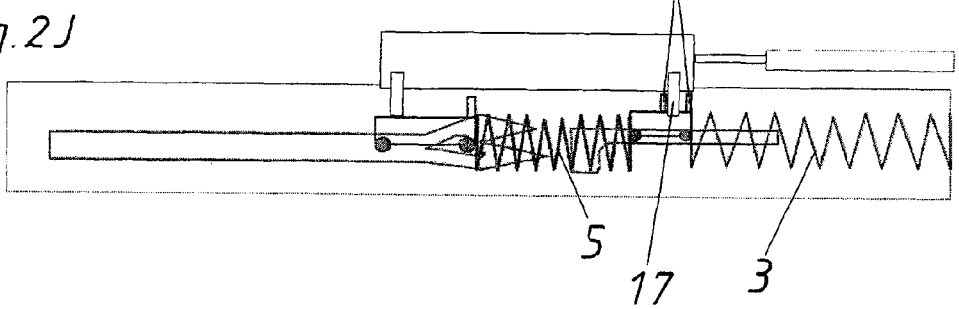

By virtue of that unlocking action, the retraction force storage member 5 is free and can be relieved of stress by pulling or pushing the moveable furniture part 2, in the closing direction SR. In that case, the force is transmitted from the retraction force storage member 5 by way of the retraction slider 13 and its left-hand (outer) catch element 26 further by the first entrainment member 17 to the moveable furniture parts. That force transmission is damped by the damping device 18. In addition, upon being pulled in, the ejection force storage member 3 is stressed (see FIG. 2J).

Figure 2K:
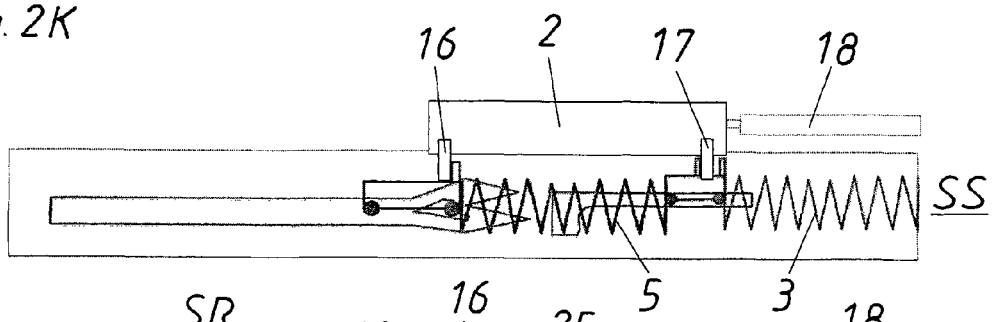

The retraction force storage member 5 is unloaded until the second entrainment member 16 bears against the actuating element 25 of the ejection slider 10. In that position as shown in FIG. 2K, the retraction force storage member 5 can no longer be further relieved of stress as it is restrained between the two entrainment members 16 and 17. In that position, the ejection force storage member 3 is almost completely stressed and the moveable furniture part 2 is in the closed position SS.

Figure 2L:
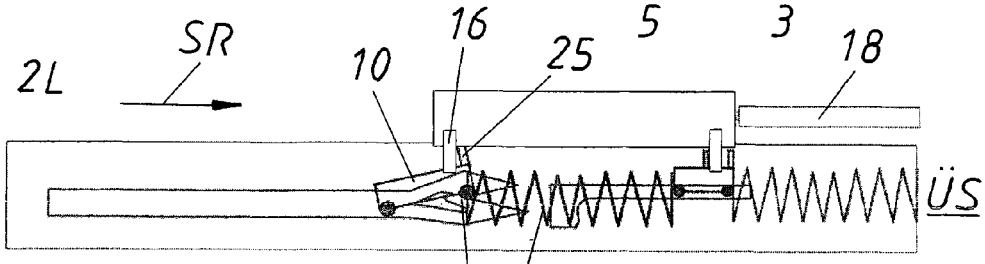

In order now to open the moveable furniture part 2, a pressure is applied to the moveable furniture part 2 in the closing direction SR by an operator. In that waym by way of the actuating element 25, the second entrainment member 16 moves the ejection slider 10 and its control pin 29 out of the latching recess of the cardioid-shaped portion 12 and the drive device 1 passes into the over-pressed closed position ÜS (see FIG. 2L).

Figure 2M:
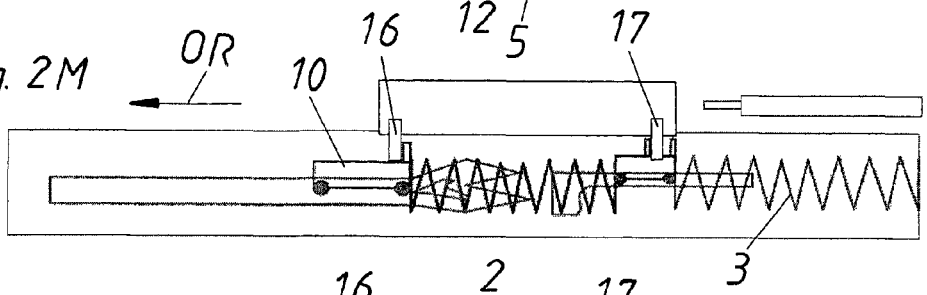

As soon as the moveable furniture part 2 is released after having been over-pressed, the ejection force storage member 3 can be relieved of stress and by way of the retraction slider 13 and the restrained retraction force storage member 5 moves the ejection slider 10 and therewith as a further consequence the second entrainment member 16 together with the moveable furniture part 2 in the opening direction OR (see FIG. 2M).

Figure 2N:
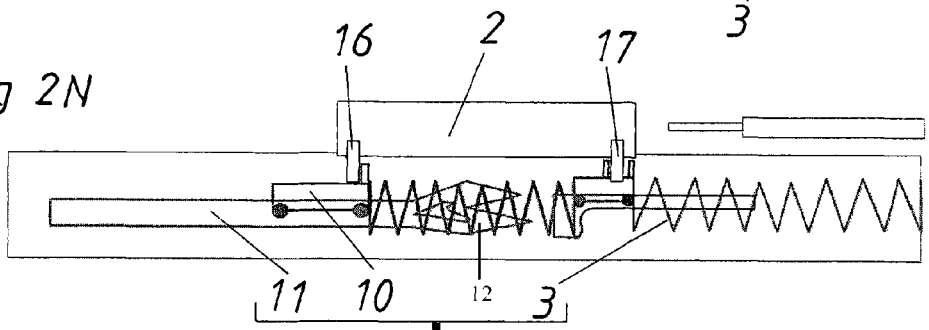
Figure 2O:
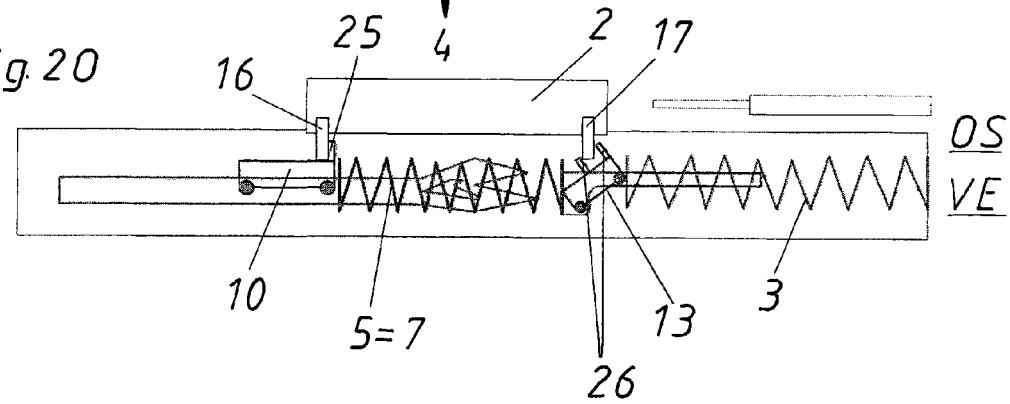
Figure 2P:
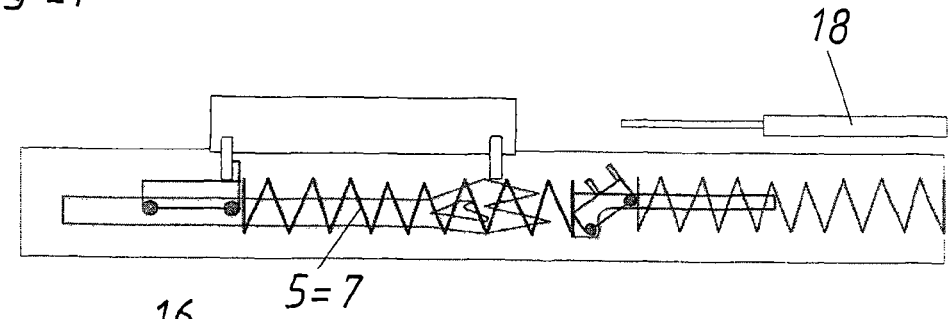
Figure 2Q:
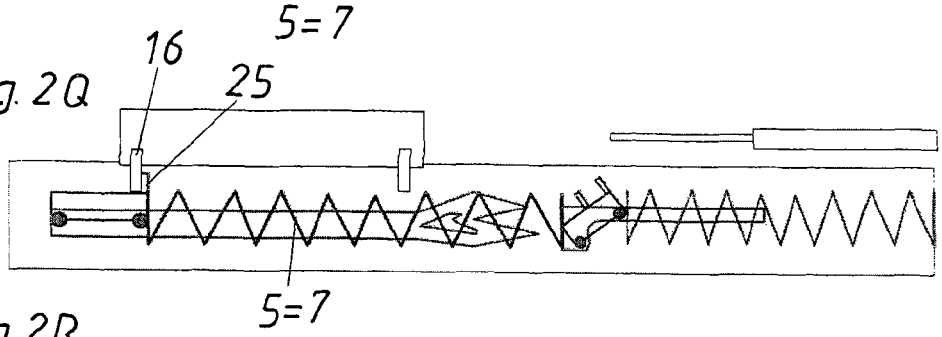

As shown in FIG. 2N, the ejection force storage member 3 can be further relieved of stress until the retraction slider 13 passes into the curved portion 15 of the sliding guide track 14 (see FIG. 2O). As a result, the open position OS is reached and the retraction slider 13 is again in the locking position VE. In addition, the first entrainment member 17 is no longer held in that position between the catch elements 26 and so the retraction force storage member 5 which hitherto was only partially relieved of stress can also function as an assistance force storage member 7 and moves the moveable furniture part 2 by way of the ejection force storage member 3 and its actuating element 25 into the further open position OS1 (see FIGS. 2P, 2Q and 2R).

Figure 2R:
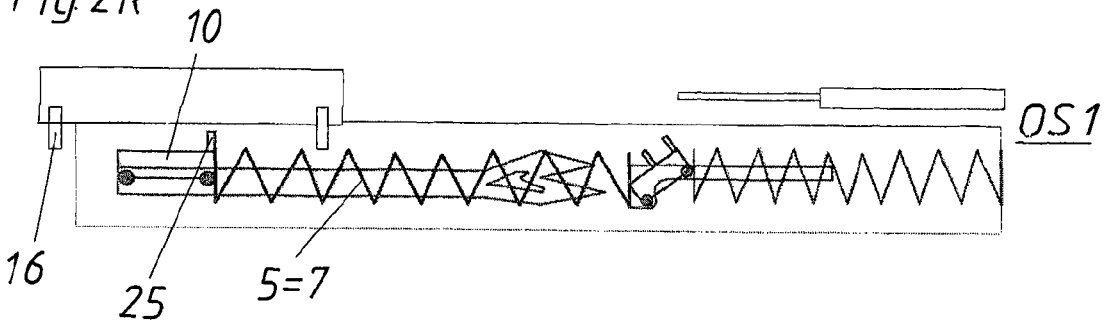

In FIG. 2R, the starting position shown in FIG. 2A is reached again, in which case the damping device 18 has also moved back into the starting position, as is known per se. For example, a fluid damper can be used as the damping device 18. A return spring can be arranged in the cylinder for the return movement of the damping piston.

Figure 3A:
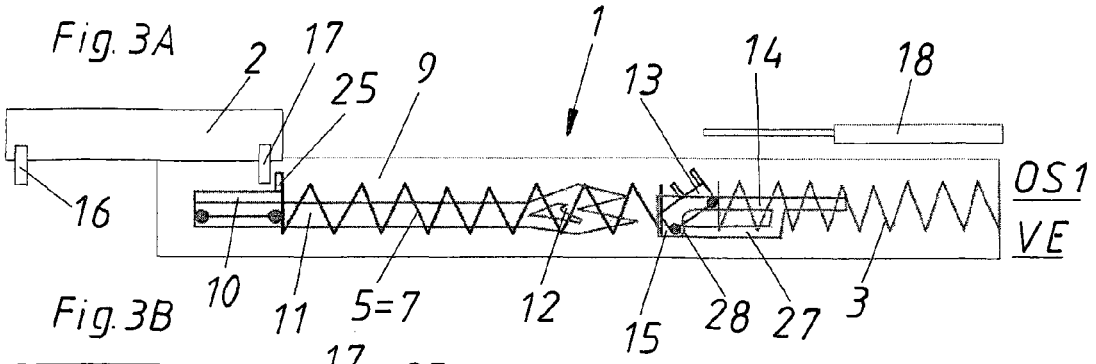
Figure 3B:
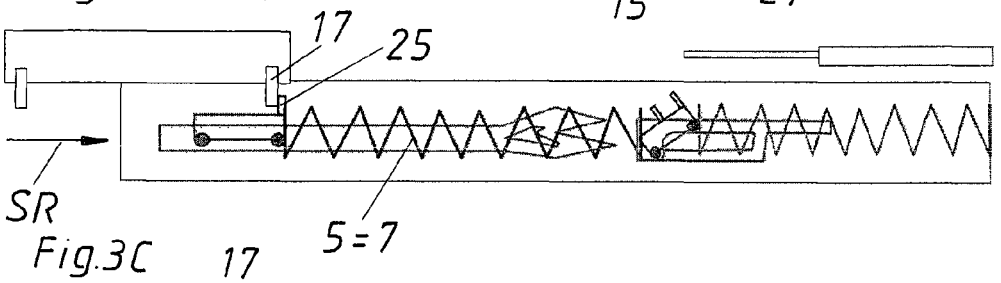
Figure 3C:
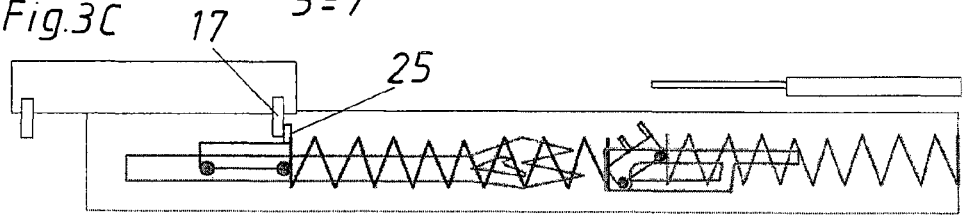
Figure 3D:
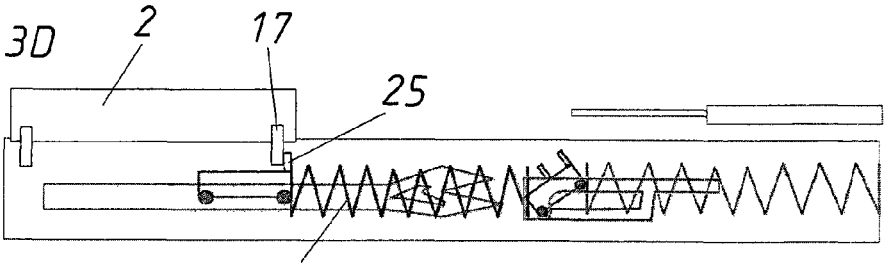
Figure 3E:
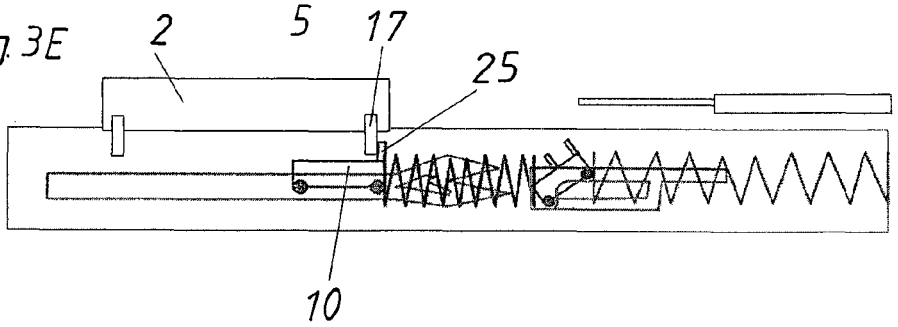
Figure 3F:
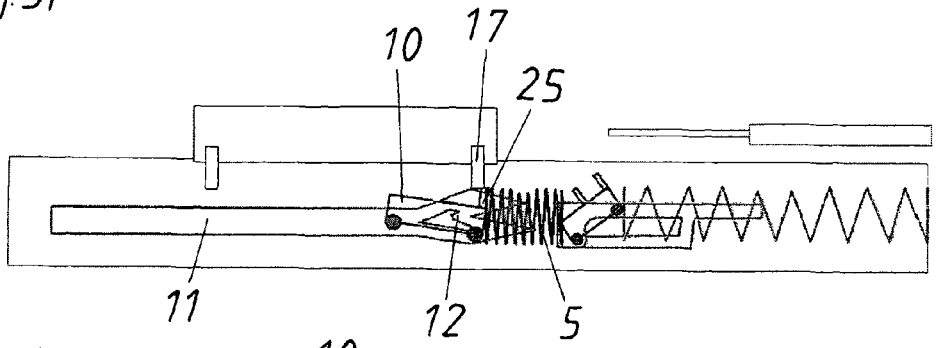
Figure 3G:
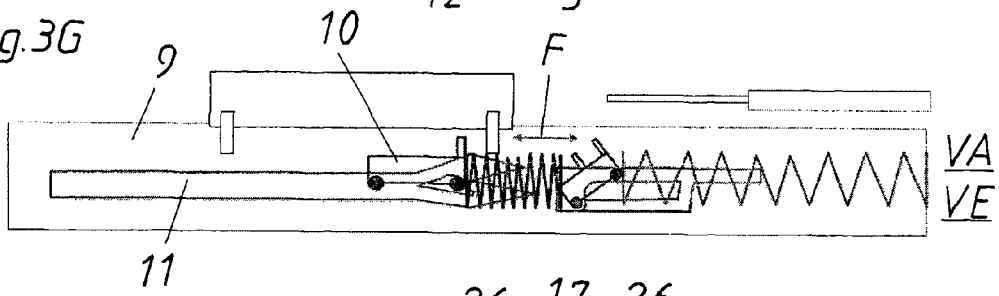
Figure 3H:
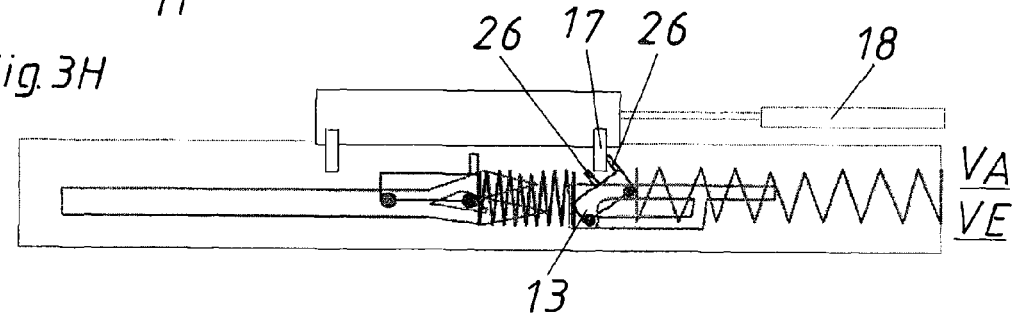
Figure 3I:
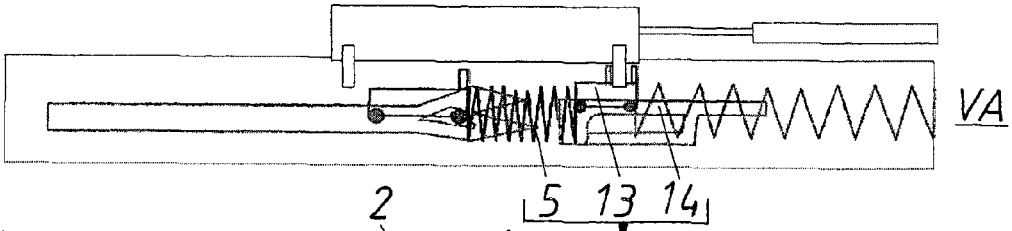
Figure 3J:
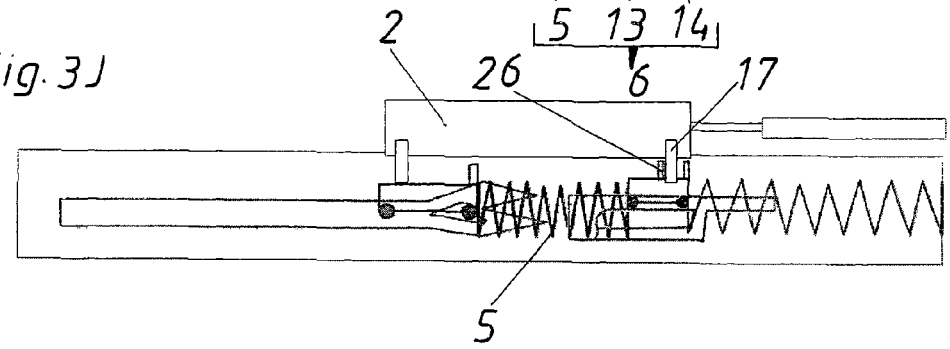
Figure 3K:
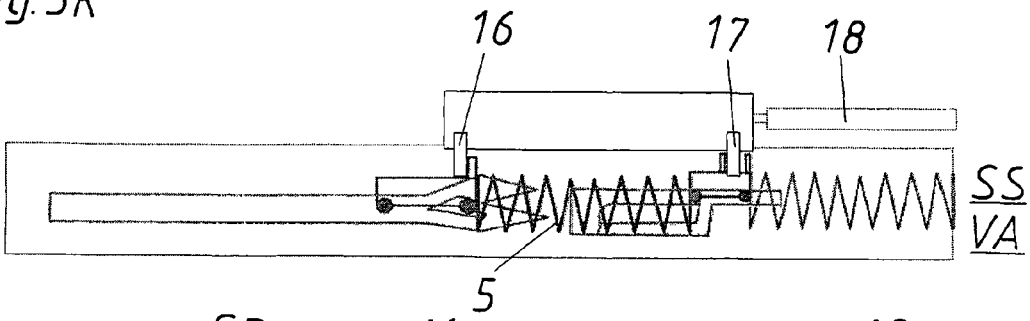
Figure 3L:
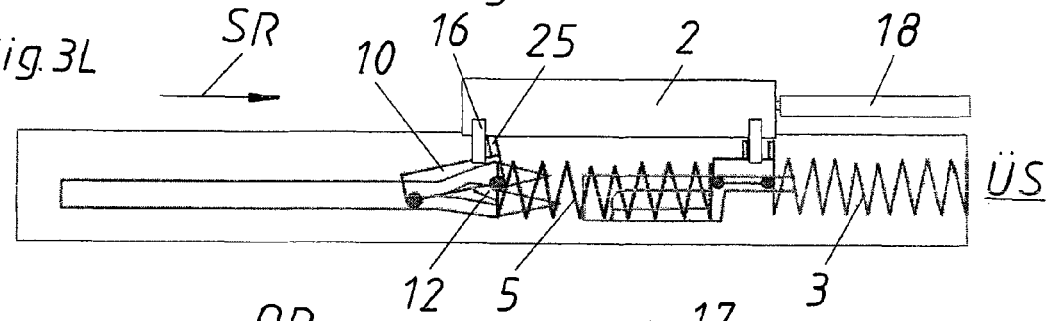
Figure 3M:
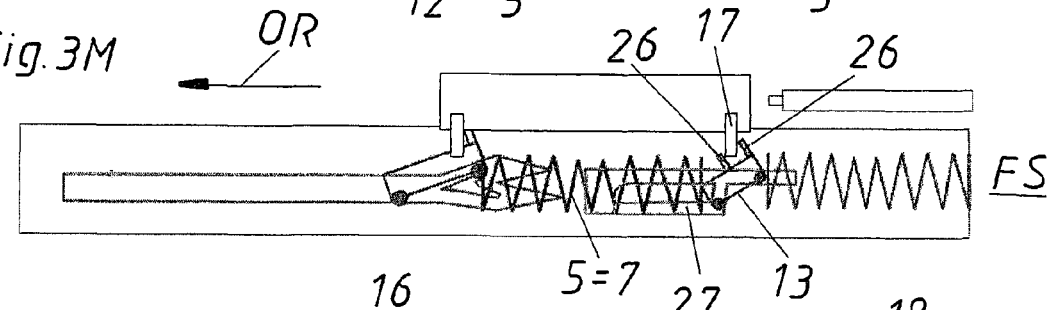
Figure 3N:
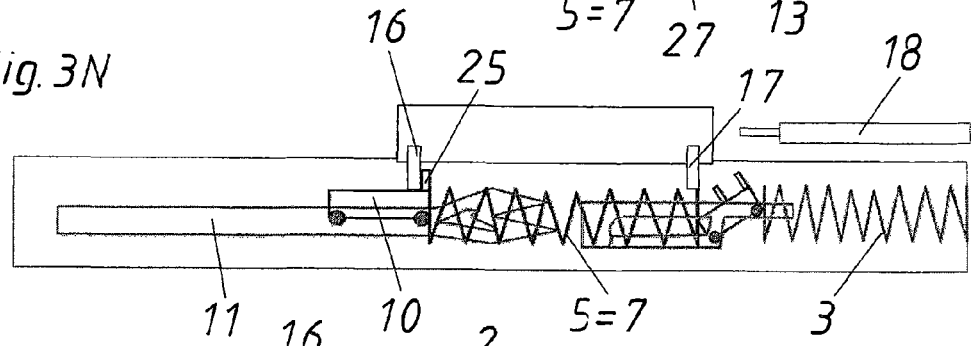
Figure 3O:
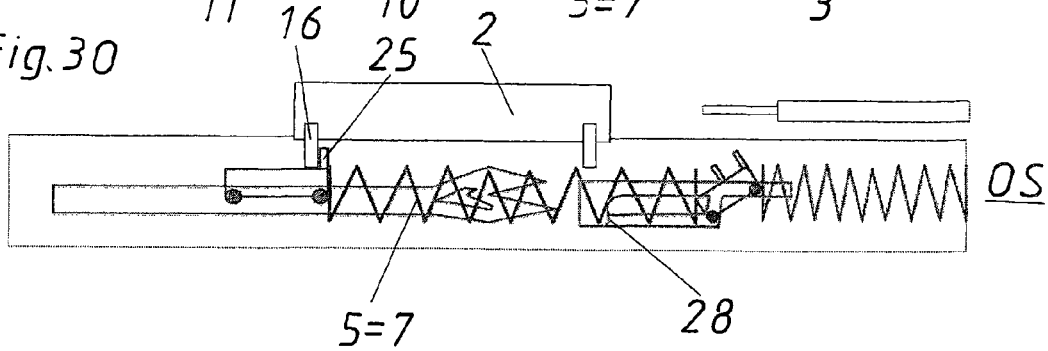
Figure 3P:
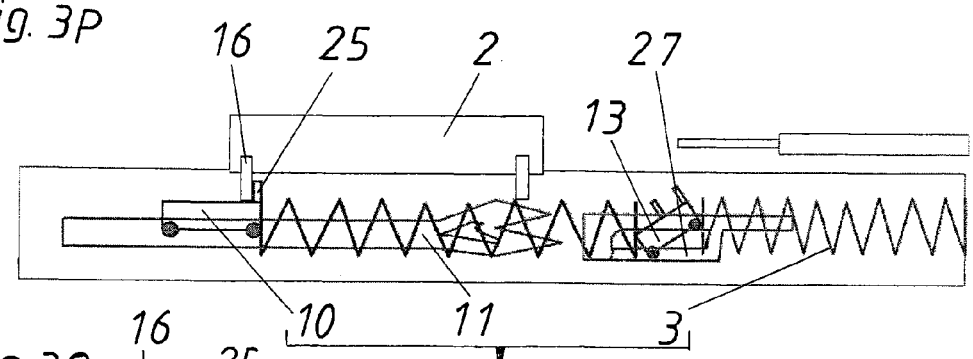
Figure 3Q:
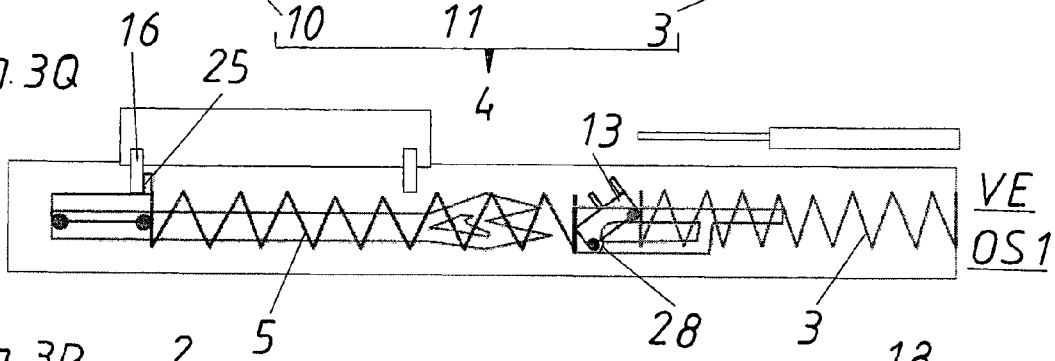
Figure 3R:
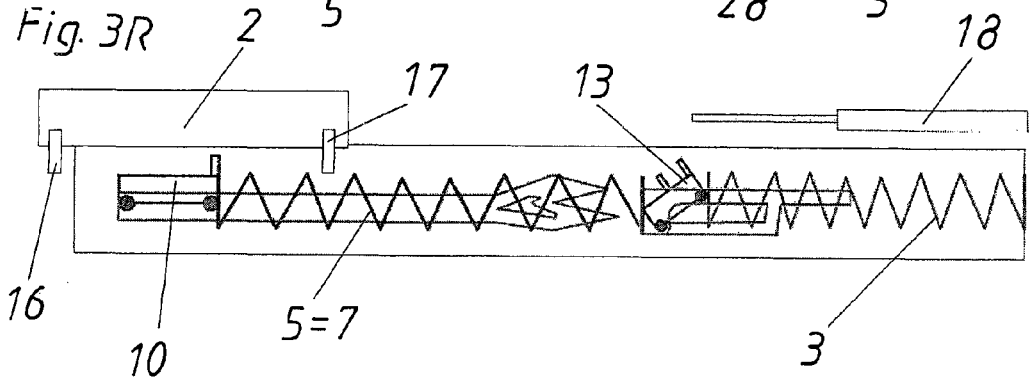

A second variant of the present invention is shown in FIGS. 3A through 3R. In this case, unlike the first variant, the sliding guide track 14 additionally has a deflection portion 27. As a result, it is not the ejection force storage member 3 that moves the moveable furniture part out of its closed position SS, but the assistance force storage member 7. In contrast, the ejection force storage member 3 moves the moveable furniture part 2 out of its open position OS into a further open position OS1.

It will be seen from FIG. 3A that the retraction slider 13 is in the locking position VE. In that case a part of the retraction slider 13 bears against the return travel block 28 which can be passed over only in the opening direction OR so that the retraction slider 13 cannot move into the deflection portion 27 due to relief of the stress of the retraction force storage member 5.

FIGS. 3B through 3L correspond to FIGS. 2B through 2L, for which reason a detailed description of this second variant is continued as described hereinafter only at FIG. 3L.

By over-pressing the moveable furniture part in the closing direction SR, the furniture part reaches the over-pressed closed position ÜS. In that case, the ejection slider 10 is unlocked and the moveable furniture part is moved in the opening direction OR (see FIG. 3M). By virtue of that movement in the opening direction OR the retraction slider 13 also passes into the deflection portion 27 of the sliding guide track 14 by virtue of the corresponding configuration thereof. As a result, the first entrainment member 17 comes out of engagement with the catch elements 26 and the release position FS is reached. Thus, in contrast to the first variant (see FIG. 2M), the retraction force storage member 5 is no longer restrained between the entrainment members 16 and 17, but the retraction force storage member 5 can function as the assistance force storage member 7 and move the moveable furniture part 2 out of the closed position SS into the open position OS (see FIGS. 3N and 3O).

As soon as the assistance force storage member 7 is relieved of stress to such an extent that the spring force of the ejection force storage member 3 is greater than the remaining spring force of the assistance force storage member 7, the ejection force storage member 3 can be relieved of stress and move the moveable furniture part 2 out of an open position OS into a further open position OS1 (see FIGS. 3P and 3Q). That relief of stress on the ejection force storage member 3 provides that the retraction slider 13 moves along the deflection portion 27 and passes over the preferably resiliently mounted return travel block 28, whereby the retraction slider 13 passes into the locking position VE again. In addition, the moveable furniture part 2 is moved into the further open position OS1.

In FIG. 3R the starting position is again reached, in which the moveable furniture part 2 is freely moveable.

This invention therefore provides a drive device 1 having an ejection device 4 and a retraction device 6, in which on the one hand the retraction force storage member 5 delivers energy to the ejection force storage member 3 upon retraction and on the other hand both the ejection force storage member 3 and also the retraction force storage member 5 functioning as the assistance force storage member 7 act serially in succession on the moveable furniture part 2 upon ejection.

The invention claimed is:

1. A drive device for a moveable furniture part, said drive device comprising:

an ejection device having an ejection force accumulator configured to eject the moveable furniture part into an open position; and a retraction device having a retraction force accumulator configured to retract the moveable furniture part from the open position into a closed position;

wherein said ejection force accumulator is further configured to be loaded by said retraction force accumulator upon retraction of the moveable furniture part; and wherein said retraction force accumulator is further configured to serve as an assistance force accumulator for assisting said ejection force accumulator in ejecting the moveable furniture part.

2. The drive device as set forth in claim 1, wherein the open position is an intermediate open position, said ejection force accumulator being configured to move the moveable furniture part out of the closed position into the intermediate open position without assistance.

3. The drive device as set forth in claim 2, wherein said retraction force accumulator is configured to serve as said assistance force accumulator to move the moveable furniture part from the intermediate open position into a fully open position.

4. The drive device as set forth in claim 1, wherein the open position is one of an intermediate open position and a fully open position, said retraction force accumulator is configured to serve as said assistance force accumulator to move the moveable furniture part from the intermediate open position into the fully open position.

5. The drive device as set forth in claim 1, wherein the open position is a fully open position, said assistance force accumulator is configured to move the moveable furniture part out of the closed position into an intermediate open position without assistance.

6. The drive device as set forth in claim 5, wherein said ejection force accumulator is configured to move the moveable furniture part from the intermediate open position into the fully open position.

7. The drive device as set forth in claim 1, wherein said ejection force accumulator and said assistance force accumulator are configured to move the moveable furniture part serially in succession upon ejection.

8. The drive device as set forth in claim 1, wherein each of said ejection force accumulator and said retraction force accumulator is a spring, a spring constant of said ejection force accumulator being less than a spring constant of said retraction force accumulator.

9. The drive device as set forth in claim 8, wherein each of said ejection force accumulator and said retraction force accumulator is a compression spring.

10. The drive device as set forth in claim 1, further comprising:

a housing to be arranged on a furniture carcass;

a retraction slider configured to be acted upon by said retraction force accumulator and displaceable along a sliding guide track in or on said housing, said retraction slider being lockable in a locking position in said sliding guide track; and an ejection slider configured to be acted upon by said ejection force accumulator and displaceable along an ejection sliding guide track in or on said housing, said ejection slider being lockable in a locking position in said ejection sliding guide track.

11. The drive device as set forth in claim 10, wherein said sliding guide track has a curved portion, said retraction slider being lockable in the locking position in said curved portion of said sliding guide track; and wherein said ejection sliding guide track has a cardioid-shaped portion, said ejection slider being lockable in the locking position in said cardioid-shaped portion of said ejection sliding guide track.

12. The drive device as set forth in claim 10, wherein said ejection force accumulator is fixed to said housing and to said retraction slider.

13. The drive device as set forth in claim 10, wherein said retraction force accumulator is fixed to said retraction slider and to said ejection slider.

14. The drive device as set forth in claim 10, wherein said retraction slider and said ejection slider are moveable serially in succession along said housing.

15. The drive device as set forth in claim 10, further comprising entrainment members attached to the moveable furniture part, said retraction slider and said ejection slider configured to be coupled to and de-coupled from said entrainment members.

16. The drive device as set forth in claim 1, further comprising a damping device for damping a retraction movement of the moveable furniture part, the retraction movement being triggered by said retraction force accumulator.

17. An article of furniture comprising:

a furniture carcass;

a moveable furniture part;

said drive device as set forth in claim 1 for moving said moveable furniture part relative to said furniture carcass.

* * * * *